US007942291B2

(12) United States Patent
Foster

(10) Patent No.: US 7,942,291 B2
(45) Date of Patent: May 17, 2011

(54) BREAK-AWAY SPRING AND PISTON ROD FOR A TRIGGER SPRAYER

(75) Inventor: Donald D. Foster, St. Charles, MO (US)

(73) Assignee: MeadWestvaco Calmar Inc., Grandview, MO (US)

( * ) Notice: Subject to any disclaimer, the term of this patent is extended or adjusted under 35 U.S.C. 154(b) by 746 days.

(21) Appl. No.: 11/957,935

(22) Filed: Dec. 17, 2007

(65) Prior Publication Data

US 2009/0152304 A1 Jun. 18, 2009

(51) Int. Cl.
*B05B 11/00* (2006.01)

(52) U.S. Cl. ..... 222/384; 222/153.13; 222/383.1; 222/340

(58) Field of Classification Search ..... 222/153.05, 222/153.06, 340, 384, 383.1
See application file for complete search history.

(56) References Cited

U.S. PATENT DOCUMENTS 6,116,472 A * 9/2000 Wanbaugh et al. ..... 222/340
6,286,723 B1 * 9/2001 Sweeton et al. ..... 222/153.13
2007/0210106 A1 9/2007 Foster

* cited by examiner

*Primary Examiner* — Kenneth Bomberg
*Assistant Examiner* — Melvin A Cartagena
(74) *Attorney, Agent, or Firm* — MWV Intellectual Property Group

(57) ABSTRACT

A manually operated trigger sprayer has an integral plastic spring and pump piston rod that are connected by a breakable connection, whereby the spring and piston rod can be assembled to the trigger sprayer as one piece and are subsequently broken into two separate pieces in response to their assembly to the trigger sprayer, or subsequent manual operation of the trigger sprayer.

19 Claims, 4 Drawing Sheets

BREAK-AWAY SPRING AND PISTON ROD FOR A TRIGGER SPRAYER

BACKGROUND OF THE INVENTION

1. Field of the Invention

The present invention pertains to the construction of a manually operated trigger sprayer in which the conventional metal coil spring and separate piston rod are replaced with an integral plastic spring and pump piston rod that are connected by a breakable connection, whereby the spring and piston rod can be assembled to the trigger sprayer as one piece and are subsequently broken into two separate pieces in response to their assembly to the trigger sprayer, or subsequent manual operation of the trigger sprayer.

2. Description of the Related Art

Handheld and hand pumped liquid dispensers commonly known as trigger sprayers are used to dispense many household products and commercial cleaners. Trigger sprayers have been designed to selectively dispense the liquids in a spray, stream, or foaming discharge. The trigger sprayer is typically connected to a plastic bottle that contains the liquid dispensed by the sprayer.

A typical trigger sprayer includes a sprayer housing that is connected to the neck of the bottle by either a screw thread connection or a bayonet-type connection. The sprayer housing is formed with a pump chamber, a liquid supply passage that communicates the pump chamber with a liquid inlet opening of the sprayer housing, and a liquid discharge passage that communicates the pump chamber with a liquid outlet opening of the sprayer housing. A dip tube is connected to the sprayer housing liquid inlet opening to communicate the pump chamber with the liquid contents of the bottle connected to the trigger sprayer.

A nozzle assembly is connected to the sprayer housing at the liquid outlet opening. Some nozzle assemblies include a nozzle cap that is rotatable relative to the sprayer housing between an "off" position where liquid discharge from the trigger sprayer is prevented, and one or more "on" positions where liquid discharge from the trigger sprayer is permitted. In addition, known nozzle assemblies can affect the liquid discharged by the trigger sprayer to discharge the liquid in a spray pattern, in a stream pattern, or as a foam.

A pump piston is mounted in the sprayer housing pump chamber for reciprocating movement between charge and discharge positions of the piston relative to the pump chamber. When the pump piston is moved to its charge position, the piston is retracted out of the pump chamber. This creates a vacuum in the pump chamber that draws liquid from the bottle, through the dip tube and into the pump chamber. When the pump piston is moved to its discharge position, the piston is moved into the pump chamber. This pumps the liquid from the pump chamber, through the liquid discharge passage of the sprayer housing and out of the trigger sprayer through the nozzle assembly.

A metal coil spring is positioned in the pump chamber and engages with the pump piston. The coil spring biases the pump piston toward the discharge position of the piston. Some known trigger sprayers have plastic springs in their pump chambers or mounted on the exterior of the sprayer housing.

A trigger is mounted on the sprayer housing for movement of the trigger relative to the trigger sprayer. The trigger is operatively connected to the pump piston to cause the reciprocating movement of the pump piston in the pump chamber in response to movement of the trigger. A user's hand squeezes the trigger toward the sprayer housing to move the trigger and move the pump piston toward the discharge position of the piston in the pump chamber. The spring pushes the piston back to the charge position of the piston relative to the pump chamber when the user's squeezing force on the trigger is released.

Inlet and outlet check valves are assembled into the respective liquid supply passage and liquid discharge passage of the trigger sprayer. The check valves control the flow of liquid from the bottle interior volume through the liquid supply passage and into the pump chamber, and then from the pump chamber and through the liquid discharge passage to the nozzle assembly of the trigger sprayer.

The typical construction of the trigger sprayer discussed above has several separate component parts. The manufacturing of each of these individual component parts contributes to the overall cost of manufacturing the trigger sprayer. In the typical trigger sprayer construction where most of the component parts are molded of a plastic material, there is a cost associated with the molding of each of the individual parts and a cost associated with assembling each of the individual parts into the trigger sprayer. Because trigger sprayers are manufactured and sold in very large numbers, even a slight reduction in the manufacturing costs of a trigger sprayer, for example by reducing the number of component parts of the trigger sprayer or reducing the assembly steps required in manufacturing the trigger sprayer could result in a significant overall reduction in the cost of manufacturing large numbers of trigger sprayers.

SUMMARY OF THE INVENTION

The trigger sprayer of the present invention achieves the desired result of reducing the manufacturing costs of a trigger sprayer. This is achieved by reducing the number of separate component parts of the typical trigger sprayer construction, and reducing the separate assembly steps required by the typical trigger sprayer construction.

The trigger sprayer of the invention has a sprayer housing construction that is similar to that of prior art trigger sprayers. The sprayer housing basically includes an integral cap that attaches to the neck of a separate bottle that contains the liquid to be dispensed by the trigger sprayer. A liquid inlet opening is provided on the sprayer housing inside the cap, and a liquid supply passage extends upwardly through the sprayer housing from the liquid inlet opening.

The sprayer housing also includes a pump chamber. The pump chamber communicates with the liquid supply passage.

The sprayer housing also has a liquid discharge tube just above the pump chamber. A liquid discharge passage extends through the liquid discharge tube to a liquid outlet opening on the sprayer housing. The liquid discharge passage communicates the pump chamber with the liquid outlet opening.

A valve assembly is inserted into the liquid supply passage and separates the liquid supply passage from the liquid discharge passage. The valve assembly includes an input valve that controls the flow of liquid from the sprayer housing inlet opening to the pump chamber, and an output valve that controls the flow of liquid from the pump chamber and through the liquid discharge passage to the liquid outlet opening.

A valve plug assembly is assembled into the liquid supply passage of the sprayer housing. The valve plug assembly includes a valve seat that seats against the input valve, and a vent baffle that defines a vent air flow path through the pump chamber to the interior of the bottle attached to the trigger sprayer.

A nozzle assembly is assembled to the trigger sprayer at the sprayer housing liquid outlet opening. The nozzle assembly is rotatable relative to the trigger sprayer to close the liquid flow path through the liquid discharge passage and the liquid outlet opening to the exterior of the sprayer, and to open the liquid flow path through the liquid discharge passage and the outlet opening to the exterior of the sprayer. The nozzle assembly has several open positions relative to the sprayer housing that enable the selective discharge of a liquid in a stream pattern, a spray pattern, and a foaming discharge.

A piston assembly is mounted in the pump chamber for reciprocating movements between charge and discharge positions of the piston assembly relative to the sprayer housing. The piston assembly includes a pump piston and a vent piston both mounted in the pump chamber. As the pump piston moves to its charge position, the vent piston is moved to a closed position where a venting air flow path through the pump chamber and through the venting air baffle is closed. As the pump piston is moved to its discharge position, the vent piston is moved to an open position in the pump chamber. This opens the venting air flow path through the pump chamber and the venting air baffle to the interior volume of the bottle attached to the trigger sprayer.

A manually operated trigger actuator is mounted on the sprayer housing for pivoting movement. The trigger is engaged by the fingers of a user's hand holding the trigger sprayer. Squeezing the trigger causes the trigger to move toward the pump chamber, and releasing the squeezing force on the trigger allows the trigger to move away from the pump chamber.

The novel construction of the trigger sprayer of the invention includes a piston rod that is operatively connected between the trigger and the piston assembly. The piston rod has a length with opposite first and second ends. The first, distal end of the piston rod engages with the trigger. The second, proximal end of the piston rod is connected to the piston assembly.

The novel construction of the trigger sprayer also includes a spring having a pair of spring arms that are integrally connected with the piston rod by a pair of breakable connections between the spring arms and the distal end of the piston rod. The pair of spring arms, the pair of breakable connections, and the piston rod are one monolithic piece of plastic material. The pair of spring arms each have the same curved lengths with opposite first and second ends. The first ends of the spring arms engage with the trigger and the second ends of the spring arms engage with the sprayer housing. The distal end of the piston rod extends from the piston assembly, between the pair of spring arms and toward the trigger. A pivoting connection is provided between the distal end of the piston rod and the trigger.

The pair of breakable connections between the piston rod and the spring arms of the spring enable the spring and the piston rod to be molded as one piece, thereby reducing the number of separate parts of the trigger sprayer. In addition, with the breakable connections connecting the pair of spring arms of the spring to the piston rod, the spring and the piston rod can be assembled as one piece to the trigger sprayer, thereby reducing the number of separate assembly steps for the trigger sprayer. Thus, the desire to reduce the number of separate component parts and to reduce the number of separate assembly steps to reduce the manufacturing costs of a trigger sprayer are achieved.

The breakable connections between the pair of spring arms and the piston rod are constructed to break, separating the pair of spring arms from the piston rod. In variant embodiments of the invention, the breakable connections between the pair of spring arms and the piston arm can be constructed to break in response to the piston rod being connected by the pivoting connection to the trigger. Additionally, the breakable connections can be constructed to break in response to relative movement between the piston rod and the spring. Still further, the breakable connections between the pair of spring arms and the piston rod can be designed to break in response to movement of the trigger relative to the sprayer housing.

DESCRIPTION OF THE DRAWINGS FIGURES

Further features of the invention are set forth in the following detailed description of the preferred embodiment of the invention and in the drawing figures wherein.

DETAILED DESCRIPTION OF THE PREFERRED EMBODIMENT

Figure 1:
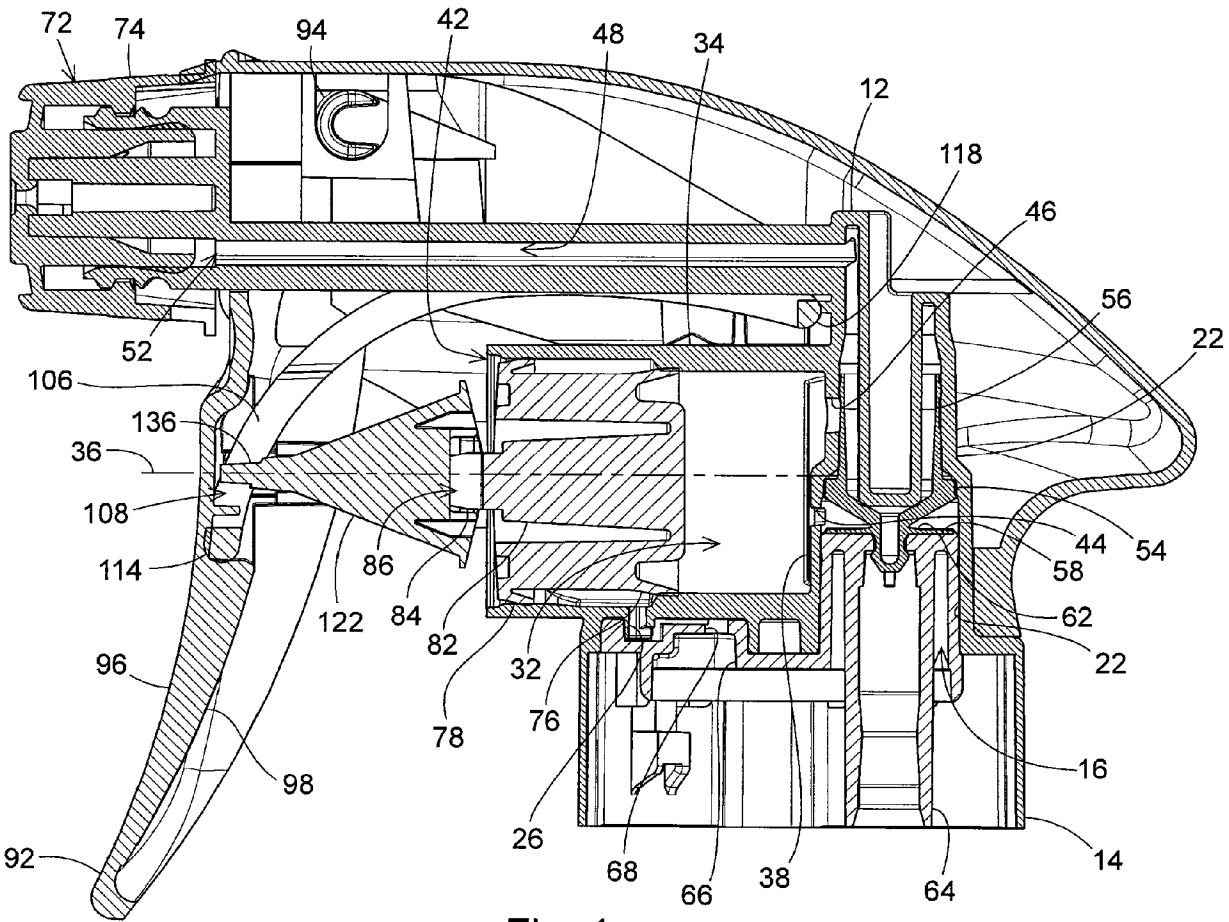
FIG. 1 is a side sectioned view of the trigger sprayer of the invention with the trigger in a forward position relative to the sprayer housing.
Figure 2:
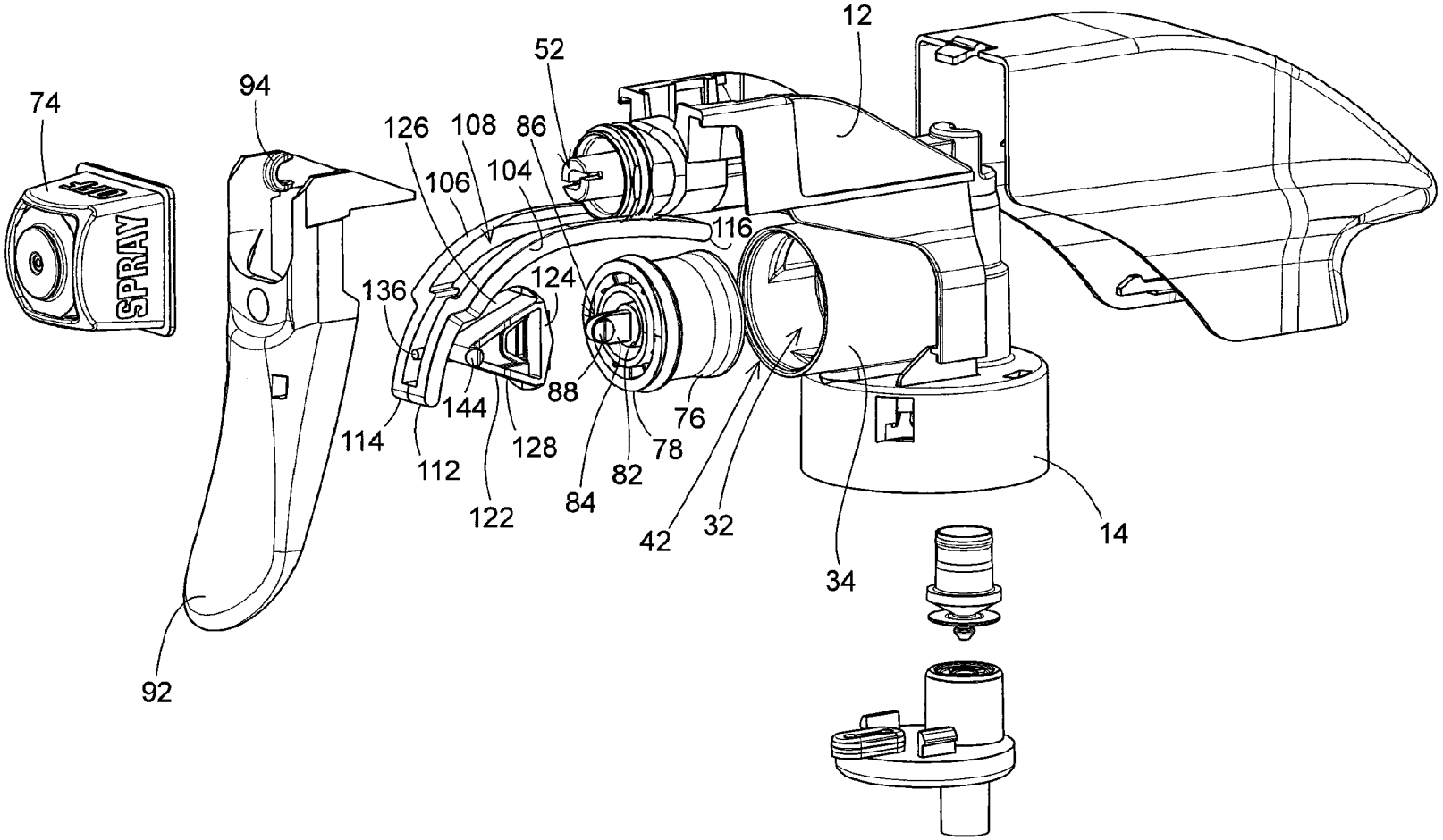
FIG. 2 is a perspective view of the disassembled component parts of the trigger sprayer.
Figure 4:
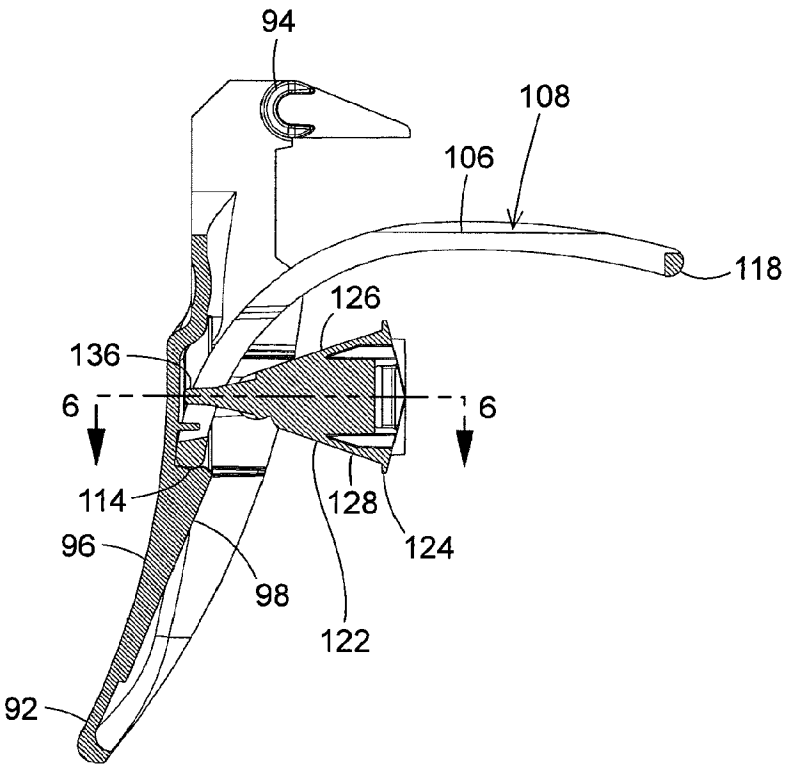
FIG. 4 is a side sectioned view of the trigger and integral spring and piston rod of the invention.
Figure 3:
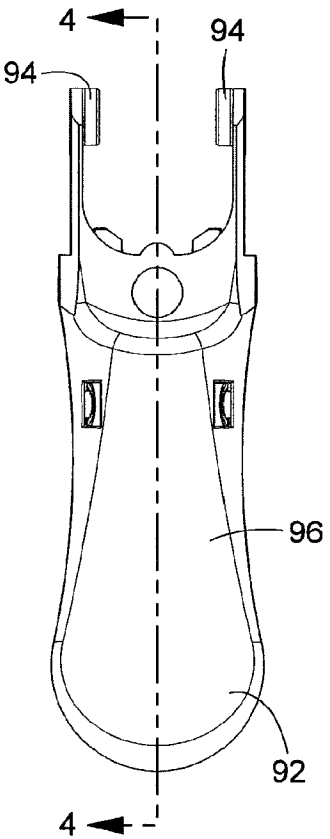
FIG. 3 is a front view of the trigger actuator.

Several component parts of the trigger sprayer of the invention are found in the typical construction of a trigger sprayer, and therefore these component parts are described only generally herein. It should be understood that although the component parts are shown in the drawing figures and are described as having a certain construction, other equivalent constructions of the component parts are known. These other equivalent constructions of trigger sprayer component parts are equally well suited for use with the novel features of the invention to be described herein.

The trigger sprayer includes a sprayer housing 12 that is formed integrally with a connector cap 14. The connector cap 14 removably attaches the trigger sprayer to the neck of a bottle containing the liquid to be dispensed by the trigger sprayer. The connector cap 14 shown in the drawing figures has a bayonet-type connector on its interior. Other types of equivalent connectors may be employed in attaching the trigger sprayer to a bottle. A liquid inlet opening 16 is provided on the sprayer housing 12 in the interior of the connector cap 14. The inlet opening 16 provides access to a liquid supply passage 18 that extends upwardly through a cylindrical liquid column 22 formed in the sprayer housing 12. An air vent opening 26 is also provided on the sprayer housing 12 in the interior of the connector cap 14.

The sprayer housing includes a pump chamber 32 contained inside a cylindrical pump chamber wall 34 on the sprayer housing 12. The pump chamber cylindrical wall 34 has a center axis 36. The interior surface of the pump chamber wall 34 has a smaller interior diameter section adjacent a rear wall 38 of the pump chamber, and a larger interior diameter section adjacent an end opening 42 of the pump chamber. The smaller interior diameter portion of the pump chamber 32 functions as the liquid pump chamber, and the larger interior diameter portion of the pump chamber 32 functions as a portion of a venting air flow path through the sprayer housing 12. The vent opening 26 in the sprayer housing connector cap 14 communicates the larger interior diameter portion of the pump chamber 32 with a bottle connected to the trigger sprayer. A pair of openings 44, 46 pass through the pump chamber rear wall 38 and communicate the interior of the pump chamber with the liquid supply passage 18. The first of the openings 44 is the liquid input opening to the pump chamber 32, and the second of the openings 46 is the liquid output opening from the pump chamber.

A liquid discharge tube is also formed on the sprayer housing 12 and provides the liquid discharge passage 48 of the sprayer housing. One end of the liquid discharge passage 48 communicates with the liquid supply passage 18 in the liquid column 22, and the opposite end of the liquid discharge passage 48 exits the sprayer housing 12 through a liquid outlet opening 52 on the sprayer housing.

A valve assembly comprising an intermediate plug 54, a resilient sleeve valve 56 and a resilient disk valve 58 is assembled into the liquid supply passage 18. The valve assembly is inserted through the liquid inlet opening 16 and the valve assembly plug 54 seats tightly in the liquid supply passage 18 between the pump chamber input opening 44 and the pump chamber output opening 46. Thus, the plug 54 separates the liquid inlet opening 16 into the pump chamber 32 from the liquid outlet opening 52 from the pump chamber 32. The disk valve 58 is positioned in the liquid supply passage 18 to control the flow of liquid from the liquid inlet opening 16 into the pump chamber 32, and to prevent the reverse flow of liquid. The sleeve valve 56 is positioned to control the flow of liquid from the pump chamber 32 and through the liquid discharge passage 48 and the liquid outlet opening 52, and to prevent the reverse flow of liquid.

A valve plug assembly comprising a valve seat 62, a dip tube connector 64, and an air vent baffle 66 is assembled into the liquid inlet opening 16 inside the connector cap 14. The valve seat 62 is cylindrical and seats against the outer perimeter of the valve assembly disk valve 58. A hollow interior bore of the valve seat 62 allows liquid to flow through the bore and unseat the disk valve 58 from the seat 62 as the liquid flows from the inlet opening 16 to the pump chamber 32. The periphery of the disk valve 58 seats against the valve seat 62 to prevent the reverse flow of liquid. The dip tube connector 64 is a cylindrical connector at the center of the plug assembly that connects to a separate dip tube (not shown). The air vent baffle 66 covers over but is spaced from the vent opening 26 in the connector cap 14. The baffle 66 has a baffle opening 68 that is not aligned with the vent opening 26, but communicates with the vent opening through the spacing between the air vent baffle 66 and the interior surface of the connector cap 14. This allows air to pass through the vent opening 26 and through the baffle spacing and the baffle opening 68 to vent the interior of the bottle connected to the trigger sprayer to the exterior environment of the sprayer. Because the vent opening 26 and baffle opening 68 are not directly aligned, the air vent baffle 66 prevents liquid in the bottle from inadvertently passing through the baffle opening 68, the baffle spacing and the vent opening 26 to the exterior of the trigger sprayer should the trigger sprayer and bottle be inverted or positioned on their sides.

A nozzle assembly 72 is assembled to the sprayer housing 12 at the liquid outlet opening 46. The nozzle assembly 72 can have the construction of any conventional known nozzle assembly that produces the desired discharge pattern of liquid from the trigger sprayer. In the preferred embodiment of the invention, the nozzle assembly 72 has a rotatable nozzle cap 74 that selectively changes the discharge from a "off" condition where the discharge is prevented, to a "spray" condition, a "stream" condition and/or a foaming discharge.

A piston assembly comprising a liquid pump piston 76 and a vent piston 78 is mounted in the pump chamber 32 for reciprocating movement. The pump piston 76 reciprocates between a charge position and a discharge position in the pump chamber 32. In the charge position, the pump piston 76 moves in a forward direction away from the pump chamber rear wall 38. This expands the interior of the pump chamber creating a vacuum in the chamber that draws liquid into the pump chamber, as is conventional. In the discharge position, the pump piston 76 moves in an opposite rearward direction into the pump chamber toward the pump chamber rear wall 38. This forces the liquid drawn into the pump chamber 32 through the output opening 46, past the sleeve valve 56 and through the liquid discharge passage 48 and the liquid outlet opening 52. As the pump piston 76 reciprocates in the pump chamber 32 between the charge and discharge positions, the vent piston 78 reciprocates between a vent closed position where the vent piston 78 engages against the interior surface of the pump chamber wall 34, and a vent open position where the vent piston 78 is spaced inwardly from the interior of the pump chamber wall 34. In the vent open position of the vent piston 78, air from the exterior environment of the sprayer can pass through the pump chamber opening 42, past the vent piston 78 to the vent opening 26, and then through the spacing between the baffle 66 and the connector cap 14, through the vent baffle opening 68 and to the interior of the bottle connected to the trigger sprayer.

A center post 82 extends axially from the piston assembly to a distal end 84 of the post. A vertically oriented slot 86 extends axially into the post distal end 84. A pair of horizontal pivot pins 86 project radially outwardly from opposite sides of the post distal end 84. The pins 88 are positioned on opposite sides of the axial slot 86. Thus, the slot 86 allows the pivot pins 88 to resiliently flex radially inwardly toward each other.

Figure 6:
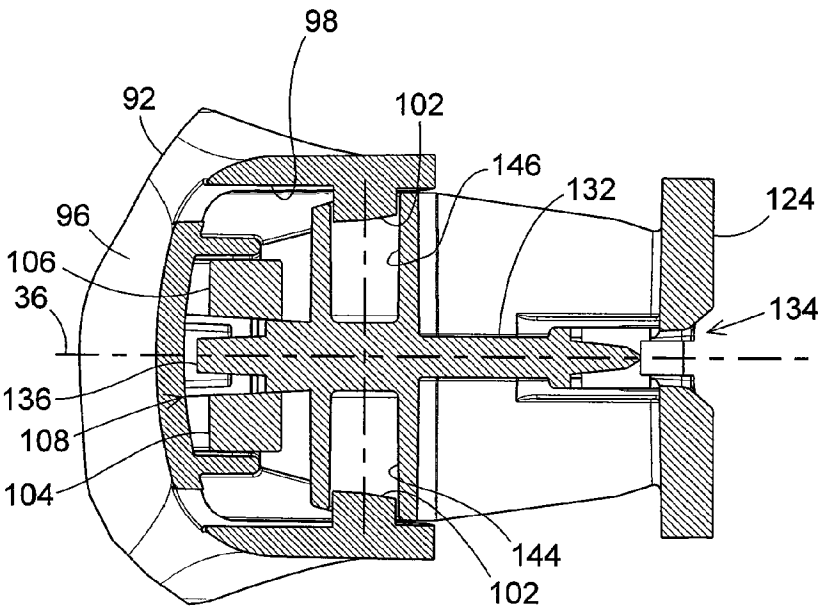

A manually operated trigger actuator 92 is mounted on the sprayer housing 12 for movement of the trigger relative to the sprayer housing. The trigger 92 has a pair of pivot pins 94 that project from opposite sides of the trigger and mount the trigger to the sprayer housing 12 for pivoting movement. Squeezing the trigger causes the trigger to pivot rearwardly toward the pump chamber 32, and releasing the squeezing force on the trigger allows the trigger to pivot forwardly away from the pump chamber. The construction of the trigger includes a finger engagement surface 96 that is engaged by the fingers of a user's hand. Opposite the finger engagement surface 96, the trigger has an interior surface 98 that faces toward the sprayer housing 12. A pair of connection posts 102 are provided on the interior surface 98. The connection posts 102 are axially aligned and are axially spaced from each other on opposite sides of the trigger 92. This is best seen in FIG. 6.

The novel construction of the trigger sprayer of the invention includes a spring and a piston rod that are interconnected by a breakable connection and are formed as one monolithic piece, thereby reducing the number of separate component parts that go into the construction of the trigger sprayer, and reducing the number of assembly steps required in manufacturing the trigger sprayer.

The spring is comprised of a pair of spring arms 104, 106 that are mirror images of each other and are spaced from each other, defining a void 108 between the spring arms. Each of the spring arms 104, 106 has a narrow, elongate length that extends between opposite first 112, 114 and second 116, 118 ends of the spring arms. In assembling the spring to the trigger sprayer, the spring arm first ends 112, 114 engage against the interior surface 98 of the trigger 92. From the first ends 112, 114, the lengths of the spring arms 104, 106 curve upwardly away from the trigger 92 and toward the sprayer housing 12. The curved lengths of the spring arms 104, 106 extend over the pump chamber 32 to the second ends 116, 118 of the spring arms that engage with the sprayer housing 12. The spring arm second ends 116, 118 engage with the sprayer housing 12 between the pump chamber 32 and the liquid discharge tube 48 of the sprayer housing. The bowed or curved configurations of the spring arms 104, 106 bias the trigger 92 away from the sprayer housing 12. Manually squeezing the trigger 92 compresses the spring arms 104, 106 between the trigger 82 and the sprayer housing 12, and increases the curvature of the intermediate portions of the spring arms 104, 106. When the squeezing force on the trigger 82 is removed, the resiliency of the spring arms 104, 106 pushes the trigger away from the sprayer housing 12.

A piston rod 122 is operatively connected between the trigger 92 and the liquid pump piston 76 and vent piston 78. A circular flange 124 is provided at the rearward end of the piston rod 122. A top flange 126 and bottom flange 128 extend forwardly from the circular flange 124 and converge toward each other. A center flange 132 connects the top flange 126 and bottom flange 128. The circular flange 124 has a center opening 134 and the center flange 132 extends across the opening 134. The center post distal end 84 of the piston assembly extends through the circular flange opening 132. The center post pins 88 engage against the opposite side of the circular flange 124 from the liquid pump piston 76 and vent piston 78, and the piston rod center flange 132 engages in the slot 86 in the piston assembly center post 82, thereby providing a pivoting connection between the piston rod 122 and the liquid pump piston 76 and vent piston 78.

Figure 5:
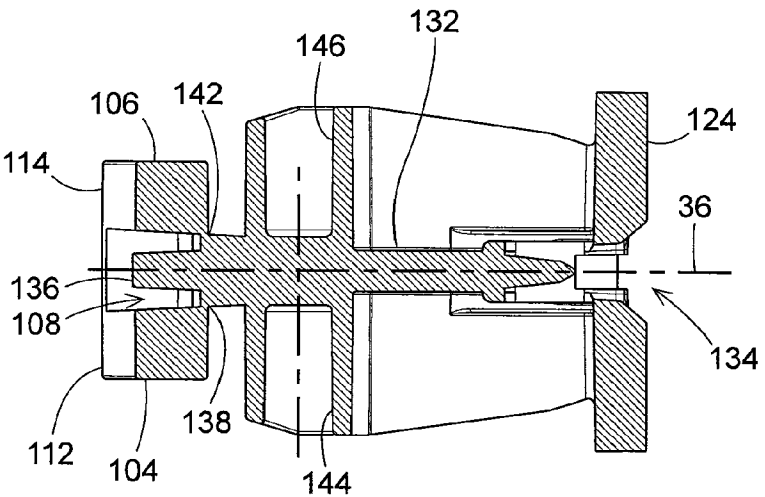
FIG. 5 is a top sectioned view of the spring and piston rod monolithically connected by a pair of breakable connections; and, FIG. 6 is a top view similar to that of FIG. 5, but after the breakable connections between the spring and piston rod have been broken.

The top flange 126 and bottom flange 128 of the piston rod extend forwardly toward the trigger 92 and converge to a projecting distal end 136 of the piston rod. The piston rod distal end 136 extends through the void 108 between the spring arms 104, 106. Referring to FIG. 5, the piston rod distal end 136 is integrally connected to the spring arms 104, 106 by a pair of breakable connections 138, 142. The breakable connections, 138, 142 together with the piston rod distal end 136 and the interconnected spring arms 104, 106 are formed as one monolithic piece as shown in FIG. 5. The breakable connections 138, 142 are specifically designed to break on relative movement between the piston rod distal end 136 and the pair of spring arms 104, 106, thereby separating the piston rod 122 from the spring arms 104, 106. There are several equivalent ways in which the breakable connections 138, 142 can break to separate the piston rod 122 from the spring arms 104, 106.

The piston rod top flange 126 and bottom flange 128 converge toward each other and meet at a pair of piston rod sockets 144, 146. The piston rod sockets 144, 146 are axially aligned and face in opposite directions from the opposite sides of the piston rod 122. The piston rod distal end projects forwardly from the pair of sockets 144, 146. The sockets 144, 146 are dimensioned to receive the trigger connection posts 102 in the sockets in assembling the piston rod 122 to the trigger sprayer.

In assembling the spring arms 104, 106 and the piston rod 122 to the trigger sprayer, the piston rod distal end 136 is moved toward the trigger interior surface 98 until the trigger connection posts 102 are positioned opposite the piston rod sockets 104, 106. The resilience of the material of the trigger 92 causes the trigger connection posts 102 to snap into the piston rod sockets 144, 146, thereby providing a pivoting connection between the trigger 92 and the piston rod 122. As the piston rod 122 is moved toward the trigger interior surface 98, the spring arms 104, 106 engage against the trigger interior surface 98. Further forward movement of the piston rod 122 causes the breakable connections 138, 142 between the piston rod distal end 136 and the spring arms 104, 106 to break, thereby separating the piston rod 122 from the spring.

Alternatively, if connecting the piston rod 122 to the trigger 92 in the manner described above does not result in the breakable connections 138, 142 breaking, relative movement between the spring arms 104, 106 and the piston rod 122 when the trigger 92 is manually reciprocated will result in breaking the breakable connections 138, 142. Furthermore, relative movement between the spring arms 104, 106 and the piston rod 122 as the piston rod 122 is assembled to the trigger sprayer can result in breaking the breakable connections 138, 142.

Thus, providing the spring arms 104, 106 with the breakable connections 138, 142 to the piston rod 122 provides the spring and piston rod as a single, monolithic component part of the trigger sprayer. This reduces the number of separate component parts required to manufacture the trigger sprayer, and thereby reduces manufacturing costs. Furthermore, with the spring arms 104, 106 interconnected by the breakable connections 138, 142 to the piston rod 122, this single component part is assembled to the trigger sprayer in the manufacturing of the trigger sprayer, thus reducing the assembly steps. This further reduces the manufacturing costs of the trigger sprayer.

Although the trigger sprayer of the invention has been described above by reference to a specific embodiment of the trigger sprayer, it should be understood that modifications and variations could be made to the trigger sprayer without departing from the intended scope of the following claims.

What is claimed is:

1. A manually operated trigger sprayer comprising:

a sprayer housing having a pump chamber in the sprayer housing, a liquid inlet opening on the sprayer housing, a liquid supply passage extending through the sprayer housing and communicating the liquid inlet opening with the pump chamber, a liquid outlet opening on the sprayer housing, and a liquid discharge passage extending through the sprayer housing and communicating the liquid outlet opening with the pump chamber;

a pump piston mounted in the pump chamber for reciprocating movement between charge and discharge positions of the pump piston in the pump chamber;

a trigger mounted on the sprayer housing for movement of the trigger relative to the sprayer housing;

a spring mounted between the sprayer housing and the trigger;

a piston rod projecting from the pump piston and engaging with the trigger; and a breakable connection between the piston rod and the spring, the breakable connection between the piston rod and the spring being constructed to break in response to relative movement between the piston rod and the spring.

2. The trigger sprayer of claim 1, further comprising:

the breakable connection between the piston rod and the spring being constructed to break in response to movement of the trigger relative to the sprayer housing.

3. The trigger sprayer of claim 1, further comprising:

the piston rod, the spring, and the breakable connection between the piston rod and the spring being one monolithic piece of material.

4. The trigger sprayer of claim 1, further comprising:
the spring having a curved length with opposite first and second ends, the spring first end engaging against the trigger and the spring second end engaging against the sprayer housing.

5. The trigger sprayer of claim 1, further comprising:
a pivoting connection between the trigger and the piston rod that enables relative pivoting movement between the trigger and the piston rod, the pivoting connection between the trigger and the piston rod being separate from the breakable connection between the piston rod and the spring, and the breakable connection between the piston rod and the spring being constructed to break in response to relative pivoting movement between the trigger and the piston rod.

6. The trigger sprayer of claim 5, further comprising:
a pair of pivot posts on the trigger;
a pair of sockets on the piston rod; and,
the pivoting connection between the trigger and the piston rod being defined by engagement of the pair of posts on the trigger in the pair of sockets on the piston rod.

7. The trigger sprayer of claim 1, further comprising:
the breakable connection being one of a pair of breakable connections between the piston rod and the spring, the pair of breakable connections being on opposite sides of the piston rod.

8. The trigger sprayer of claim 7, further comprising:
the spring having a pair of separate spring arms that extend across opposite sides of the piston rod and are connected to the piston rod by the pair of breakable connections.

9. A manually operated trigger sprayer comprising:
a sprayer housing having a pump chamber in the sprayer housing, a liquid inlet opening on the sprayer housing, a liquid supply passage extending through the sprayer housing and communicating the liquid inlet opening with the pump chamber, a liquid outlet opening on the sprayer housing, and a liquid discharge passage extending through the sprayer housing and communicating the liquid outlet opening with the pump chamber;
a pump piston mounted in the pump chamber for reciprocating movement between charge and discharge positions of the pump piston in the pump chamber;
a trigger mounted on the sprayer housing for movement of the trigger relative to the sprayer housing;
a spring mounted between the sprayer housing and the trigger, the spring having a pair of spaced spring arms having equal lengths and opposite first and second ends, the first ends of the spring arms engaging with the trigger and the second ends of the spring arms engaging against the sprayer housing;
a piston rod projecting from the pump piston to a distal end of the piston rod, the piston rod distal end extending between the pair of spring arms toward the trigger; and,
at least one breakable connection between the distal end of the piston rod and the pair of spring arms;
the at least one breakable connection between the distal end of the piston rod and the pair of spring arms being constructed to break in response to relative pivoting movement between the trigger and the piston rod.

10. The trigger sprayer of claim 9, further comprising:
the at least one breakable connection between the distal end of the piston rod and the pair of spring arms being constructed to break in response to relative movement between the distal end of the piston rod and the pair of spring arms.

11. The trigger sprayer of claim 9, further comprising:
the at least one breakable connection between the distal end of the piston rod and the pair of spring arms being constructed to break in response to movement of the trigger relative to the sprayer housing.

12. The trigger sprayer of claim 9, further comprising:
the piston rod, the pair of spring arms, and the at least one breakable connection between the distal end of the piston rod and the pair of spring arms being one monolithic piece of material.

13. The trigger sprayer of claim 9, further comprising:
a pivoting connection between the trigger and the piston rod that enables relative pivoting movement between the trigger and the piston rod, the pivoted connection being separate from the at least one breakable connection between the distal end of the piston rod and the pair of spring arms.

14. The trigger sprayer of claim 13, further comprising:
a pair of pivot posts on the trigger;
a pair of sockets on the piston rod; and,
the pivoting connection between the trigger and the piston rod being defined by engagement of the pair of posts on the trigger in the pair of sockets on the piston rod.

15. The trigger sprayer of claim 14, further comprising:
the at least one breakable connection between the piston rod distal end and the pair of spring arms being constructed to break in response to assembly of the trigger pivot posts in the piston rod sockets.

16. The trigger sprayer of claim 9, further comprising:
the at least one breakable connection being one of a pair of breakable connections between the distal end of the piston rod and the pair of spring arms, the pair of breakable connections being on opposite sides of the distal end of the piston rod.

17. A manually operated trigger sprayer comprising:
a sprayer housing having a pump chamber in the sprayer housing, a liquid inlet opening on the sprayer housing, a liquid supply passage extending through the sprayer housing and communicating the liquid inlet opening with the pump chamber, a liquid outlet opening on the sprayer housing, and a liquid discharge passage extending through the sprayer housing and communicating the liquid outlet opening with the pump chamber;
a pump piston mounted in the pump chamber for reciprocating movement between charge and discharge positions of the pump piston in the pump chamber;
a trigger mounted on the sprayer housing for movement of the trigger relative to the sprayer housing;
a spring mounted between the sprayer housing and the trigger, the spring having a pair of spring arms, the pair of spring arms being spaced from each other and having equal lengths that extend between first and second ends of the spring arms;
a piston rod projecting from the pump piston between the pair of spring arms toward the trigger, the piston rod being connected by a pivoting connection to the trigger; and,
a pair of breakable connections between the piston rod and the pair of spring arms, the pair of breakable connections being positioned on opposite sides of the piston rod, the pair of breakable connections between the piston rod and the pair of spring arms being constructed to break in response to movement of the trigger relative to the sprayer housing.

18. The trigger sprayer of claim 17, further comprising:
the pair of breakable connections between the piston rod and the pair of spring arms being constructed to break in response to relative movement between the piston rod and the pair of spring arms.

19. The trigger sprayer of claim 17, further comprising:

the trigger having a pair of pivot posts;

the piston rod having a pair of sockets;

the pivoting connection between the trigger and piston rod being defined by engagement of the pair of trigger pivot posts in the pair of piston rod sockets; and, the pair of breakable connections between the piston rod and the spring arms being constructed to break in response to assembly of the pair of trigger pivot posts in the pair of piston rod sockets.

* * * * *